United States Patent [19]

Opravil

[11] 3,975,096

[45] Aug. 17, 1976

[54] ELECTROPHOTOGRAPHIC COPYING MACHINES

[75] Inventor: Egon Opravil, Brackel, Germany

[73] Assignee: Lumoprint Zindler KG, Hamburg, Germany

[22] Filed: June 21, 1974

[21] Appl. No.: 481,784

[30] Foreign Application Priority Data

June 28, 1973 Germany ..... 2332830

[52] U.S. Cl. ..... 355/15; 15/256.52

[51] Int. Cl.[2] ..... G03G 21/00

[58] Field of Search ..... 355/15; 15/1.5, 256.52; 118/203

[56] References Cited

UNITED STATES PATENTS

| | | | |
|---|---|---|---|
| 3,190,198 | 6/1965 | Eichorn | 355/15 |
| 3,667,840 | 6/1972 | Engel et al. | 355/15 X |
| 3,672,764 | 6/1972 | Hartwig et al. | 355/15 |

*Primary Examiner*—L. T. Hix

*Attorney, Agent, or Firm*—Toren, McGeady and Stanger

[57] ABSTRACT

An electrophotographic copying machine with an improved means of cleaning the transfer drum to remove residual pigment uses a cleaning web and just a single driven pressure roller over which the web passes and which is arranged to press the web against the drum surface. The pressure roller constitutes the only movable element for guidance of the web. Preferably, the web is stored folded in concertina fashion in one chamber of a disposable cassette and the used web is returned to another chamber of the cassette. The invention obviates the need for any rotatable supply and take-up rollers for the cleaning web.

There is also provided mechanism for reliably indicating the amount of unused web remaining at any time.

14 Claims, 5 Drawing Figures

ELECTROPHOTOGRAPHIC COPYING MACHINES

FIELD OF THE INVENTION

This invention relates to electrophotographic copying machines which comprise a cylindrical transfer element with a photo-conductive surface which is electrostatically charged in an operational cycle, is illuminated by an image of an original, and in the region of the latent image is developed by a pigment or toner, whereafter the pigment image is transferred to a copy sheet and thereafter the drum surface is cleaned by means of a web which is guided against the drum surface by means of a driven pressure roller.

DESCRIPTION OF THE PRIOR ART

Such a copying machine is already known from West German Published Patent Specification No. DAS 1,522,706. In this prior art machine a fibrous cleaning web can be used which is moved relative to the drum surface. The present invention prefers such a movement of the cleaning web for the purpose of producing a wiping effect, but does not exclude the possibility that with a suitably absorptive cleaning web a relative movement between the web and the drum surface could be avoided. The web picks up residual pigment by pressing against the drum.

When webs have been used, as is also described in the aforementioned specification, such webs have been unwound from a so-called feed roller and after guidance over the pressure roller wound up again on a take-up roller. Thus, it is necessary that at least the take-up roller is driven in order to wind the web up again. Such devices are extraordinarily complicated. They require three rotating elements, mainly the pressure roller, and the feed and take-up rollers. If a regular uniform operation is to be achieved, then the drive of the take-up roller which receives the used web must be controlled in dependence upon the feed speed, since otherwise the relative speeds will change. If the pressure roller is also driven, this creates further difficulties and problems of control which can be overcome only by extremely expensive solutions.

A further difficulty lies in the fact that the alignment of the three rollers must be extremely accurate. A misalignment for example of the take-up roller relative to the other rollers, or alternatively a misalignment of one of the other elements, will lead to the formation of folds or creases in the web which can not only damage the drum surface but above all prevent satisfactory cleaning of the drum. These defects increasingly multiply with any considerable length of cleaning web; moreover, with such known arrangements, stresses always arise, since the winding up of the cleaning web is carried out against the braking action of the feed roller.

For the rest, with these known arrangements, the store of cleaning web can be supervised or monitored only with difficulty. The changes in diameter of the supply and takeup rollers occur comparatively slowly, so that in this connection a sensing of these diameters, possibly by means of a sensing arm, is very difficult.

If in such an arrangement a web reel is used then the renewal of the reel is complicated since not only must the new web be threaded around the pressure roller, but it is also necessary to replace two separate rollers, one of which is coupled to a drive mechanism and the other of which is coupled to a brake device. Also, it will be clearly apparent that the necessary replacement will create changes in the set tolerances or in the wear of the parts which are in engagement with one another, and these differences will naturally adversely affect the alignment of the rollers.

It is also known, evidently in order to attempt to meet such disadvantages, to use only one roller which is designed in a particular way in order to receive a pigment residual image. Such a roller is shown and described for example in U.S. Pat. No. 2,874,064.

For cleaning purposes a so-called brush roller is known from U.S. Pat. No. 2,832,977.

The devices of these two latter specifications are subject to the disadvantage that the surface of such rollers gradually becomes coated with pigment so that then the cleaning effect becomes less, or complicated measures must be introduced in order to clean the roller surfaces again. A brush roller has it is true the advantage that it presents an adaptable surface. The cleaning of bristle ends has considerable disadvantages however in respect of the charging of the photo-conductive drum surface, apart from the fact that uncontrolled accumulation of residual pigment can arise with direct action of the bristles.

Thus it results, as also is known from the film cleaning devices shown in U.S. Pat. Nos. 1,927,784 and 1,949,868, that with the use of a cleaning web, if the web moves synchronously or relatively in relation to the drum or film surface, a roller with the abovementioned disadvantages has also been provided, while with the use of only one rotating element, i.e. a cleaning roller, its surface is changed in a way which permits no control of the cleaning effect and which leads to increasing loss of quality.

SUMMARY OF THE INVENTION

It is an object of the present invention to avoid these disadvantages and by avoiding complex rollers and drive means for these to create, in a copying machine of the type first mentioned above, a cleaning device which comprises a continuously renewing or selectively renewable cleaning element which is guided in an invariable manner against the drum surface. Furthermore, the design is such that replacement following use is considerably simplified, and in addition a clear indication of the amount of unused web is made possible.

In accordance with the invention there is provided an electrophotographic copying machine comprising a transfer drum element having a photoconductive surface, means to charge the drum element surface electrostatically in an operational cycle, means to cause an image of an original to be copied to be exposed to the charged surface to create a latent image, means to develop the latent image by the application of a pigment material to said surface, whereafter the pigment image is arranged to be transferred to a copy sheet, and cleaning means to clean the surface of the drum element subsequent to the transfer to the copy sheet, said cleaning means comprising a web, a driven pressure roller over which the web passes and which is arranged to press the web against the drum surface, and means to strip the web from the pressure roller, said pressure roller, which is arranged to draw the web from a stationary store and from which the web is removed by said stripper means, constituting the only movable element for guidance of the web.

The invention thus resides in the combination of a guide device formed from only one pressure roller with a cleaning web, omitting other feed and take-up rollers.

In this way, smooth guidance of the cleaning web is always ensured, and in a preferred embodiment of the invention there is relative movement between the web and the drum surface.

In one preferred embodiment, the pressure roller has a resilient surface whose resilience with uniform surface pressure provides a point or sector adaptation for the entrainment of the web. In this way an adaptability corresponding to the particular structure of known directly acting cleaning rollers can be used. Such a surface acts however in the present invention only indirectly as a support element for the cleaning web which is continuously renewed, so that with a surface structured in this way any clogging and consequently any reduction in the resilience is avoided since any pigment picked up is taken off by the cleaning web.

In one preferred embodiment, the pressure roller is made of formed plastics material. In another preferred arrangement, the pressure roller is formed as a brush roller, more especially with short bristles of rubber or rubber-like material. Thus, the surface elements, and if provided the bristles, only act indirectly on the drum surface over which the cleaning web is guided.

The above-mentioned stripper means can take many different forms. In a particularly preferred arrangement, the stripper means comprises a plurality of blades or tongues which are arranged perpendicular to the axis of the pressure roller and are set into the surface of the pressure roller. By this means the surface of the pressure roller is made complete in the axial direction during substantially the whole of its rotation so that not only does its resilience remains unaltered but above all one avoids tracks of separate sectors being made on the surface of the roller in the peripheral direction and which can appear as lines on the drum surface. It is particularly advantageous if the pressure roller is slotted at the positions of the stripper tongues and if the stripper tongues fit into these slots at a portion of the pressure roller facing away from the drum, preferably slotting in as far as the roller core.

The machine of the present invention described so far has considerable advantages over the known machines referred to earlier by its combination of only one pressure roller with a cleaning web which is not otherwise guided.

This gives rise to a further advantageous feature, namely that the roller bearing can form the sole mounting element for the roller and for the web store.

It is especially advantageous if the pressure roller is mounted in a cassette which has two chambers divided by a partition wall, in one of which chambers the supply of web material is stored and in the other of which chambers the used web taken from the roller is collected, with the pressure roller being mounted at least partially in an opening in said latter chamber. Also, a releasable roller mounting can form additionally the sole mounting element for the cassette. This considerably simplifies the replacement of the unit, and the simple guidance arrangement with only one pressure roller means that the cassette itself can be designed as a disposable or throw-away unit since no special controls but only the inclusion of a simple clip coupling are necessary. It is also pointed out that by the use of only the pressure roller to guide the cleaning web a certain amount of play in the support of the cassette is of little significance.

According to a preferred embodiment, the pressure roller is provided as a closure to the cassette opening.

It is of particular advantage if the cassette partition wall is arranged to be movable and if it is movable in dependence upon the reduction in the web store volumn and the increase in the recovered used web. Guide and spring elements may be provided to align and move the partition wall. It is preferable however if the partition wall is displaced merely by the incoming used cleaning web.

Contrary to the known webs which are fed from rollers, in accordance with a preferred embodiment of the present invention the web is folded in concertina fashion in the storage chamber of the cassette. In this way a complete filling of a cubic space is possible which is not the case of course with a roller feed arrangement.

Of particular advantage is the fact that any particular position of the cassette partition wall can be used to provide an indication of the amount of unused web remaining in the store. This is of particular significance if the copying machine is designed to provide multiple copies on an automatic setting, so that one can determine at any given setting whether the amount of web remaining is sufficient for an intended multiple copy run.

In accordance with one embodiment of the invention the partition wall is provided with a lug projecting from the cassette, the lug being movable in a slot in one wall of the cassette and forming an indicator and/or switch actuating means.

It is preferable however if a magnet is arranged on the side wall of the cassette and if externally of the cassette there is provided at least one sensor, such as a reed-switch, which can trigger a counter. In this way it is possible to make the cassette completely closed so that no dust or dirt from the machine can pass into it. Furthermore, this ensures that the supply of unused cleaning web remains quite clean.

According to another preferred feature of the invention there is provided a first switch which indicates a predetermined minimum quantity of web reserve, and a second switch which is connected in particular to the machine drive in order to switch off the machine drive when the web reserve reaches the minimum setting. In this way, by simple means, the operational safety of the copying machine is increased.

BRIEF DESCRIPTION OF THE DRAWINGS

In order that the invention may be more fully understood, a preferred embodiment thereof will now be described in detail by way of example and with reference to the accompanying drawings, in which.

DESCRIPTION OF THE PREFERRED EMBODIMENT

Figure 1:
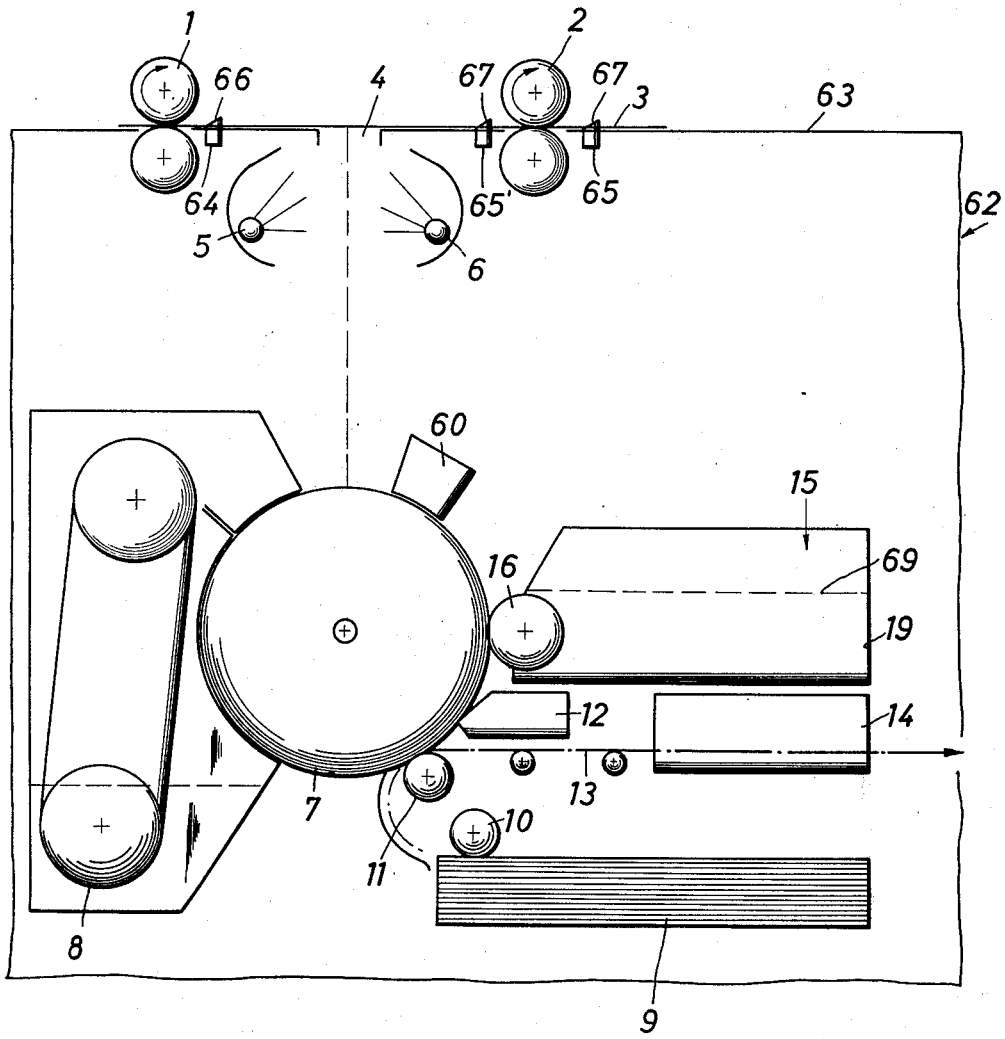
FIG. 1 is a schematic side view of a copying machine in accordance with the invention.

In the machine of FIG. 1, only parts which are essential to the present invention are illustrated.

As shown in FIG. 1, an original is fed over a guide plate 3 and over an exposure slot 4, which is illuminated by light sources 5, 6, by means of rollers 1, 2 which are driven in the sense shown by the arrows. The image is directed on to a drum 7 with a photoconductive surface which rotates in the direction shown by the arrow. The latent image which is thereby produced is developed by means of a pigment spreading device 8 of known form. Subsequent to the developing zone of the drum 7 a copy sheet which is taken from a magazine 9 by means of a withdrawal device 10 is guided synchronously to the periphery of the drum 7 by means of a pressure device 11, and then, possibly with the aid of a device 12 facilitating removal of the sheet from the drum, for example a fan or a charging device, is fed to a conveyor track 13 and a fixing or fusing device 14. Thereafter, a cleaning device which is indicated as a whole at 15 and which comprises a pressure roller 16 comes into contact with the circumference of the drum 7. An electrostatic charging arrangement 60, i.e. a corona discharge unit, is positioned between the cleaning device 15 and the exposure zone.

In FIG. 1 the housing is indicated as a whole by the reference numeral 62. The exposure slot 4 is located in the upper surface 63 of the housing which includes the guide plate 3 and the exposure slot 4. The guide plate 3 has apertures therethrough at the positions of the roller pairs 1 and 2. It should be appreciated that the invention also includes an alternative arrangement in which a separate transparent carrier plate for the original is moved guidedly on the guide plate 3, such an arrangement being known per se. In the present embodiment the guide plate 3 is transparent at least in the region of the exposure slot 4. Switches 64 and 65 are positioned on each side of the exposure slot 4. These switches have actuating elements 66 and 67 respectively which project into the path of the original and which are triggered thereby in order to effect control functions, as will be referred to in more detail later with reference to FIG. 5.

The switch 65 is positioned in advance of the roller pair 2 in the feed path of the original, and has the effect when triggered that the roller pairs 1 and 2 are switched into operation when an original is fed into the machine. The switches 64 and 65 may operate through delay devices. Moreover, an additional switch 65′ may also be provided subsequent to the roller pair 2 but in advance of the slot 4.

Figure 2:
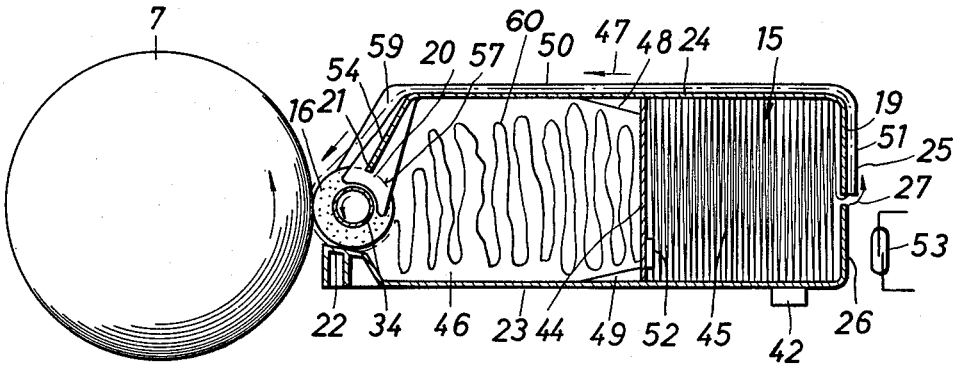
FIG. 2 is a part view of FIG. 1, partially in section, and illustrating the cleaning device in one condition.
Figure 3:
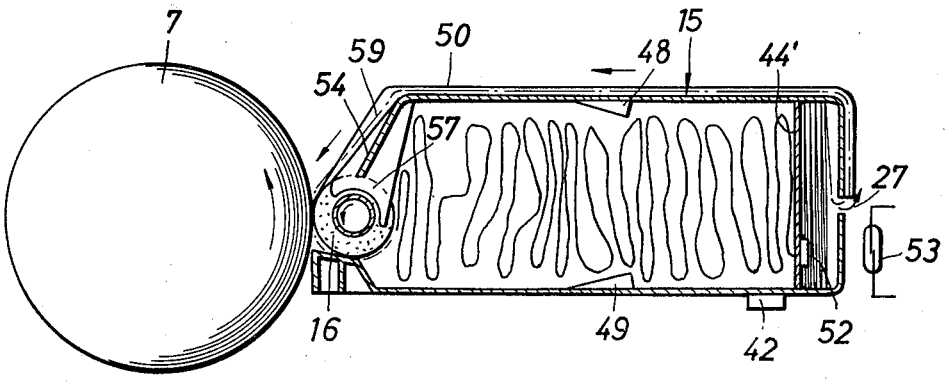
FIG. 3 is a view of the cleaning device corresponding to FIG. 2 but showing the cleaning device in another condition.
Figure 4:
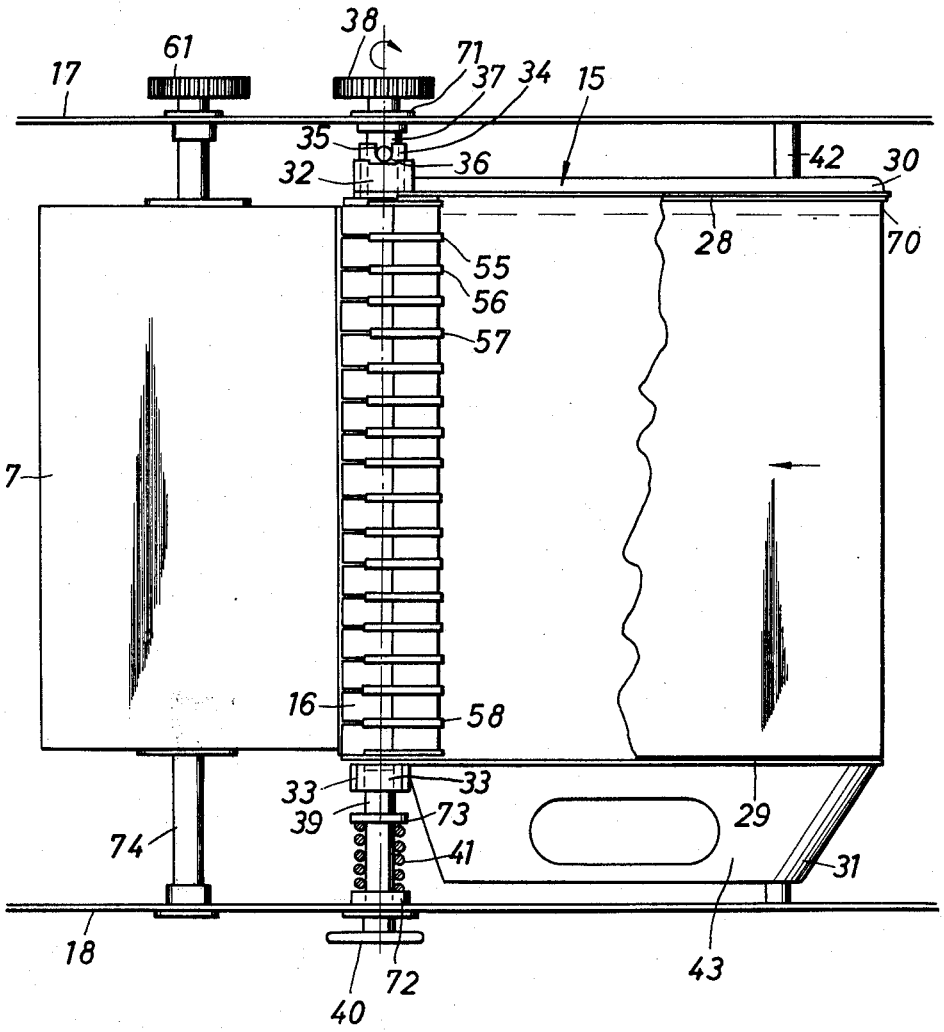
FIG. 4 is a plan view of the device shown in FIG. 2, partially in section, in order to illustrate other features; and, FIG. 5 is an electrical circuit diagram, particularly to explain the drive means.

The cleaning device 15 is shown in detail in FIGS. 2 to 4. In these Figures the same parts are shown by the same reference numerals in the several views.

As will be evident from FIG. 4, the drum 7 is mounted between side plates 17 and 18 which are arranged inside the side walls of the housing. Drive means, which are known per se and which are not described in detail, may be positioned inside or outside the side plates 17 and 18.

Figure 5:
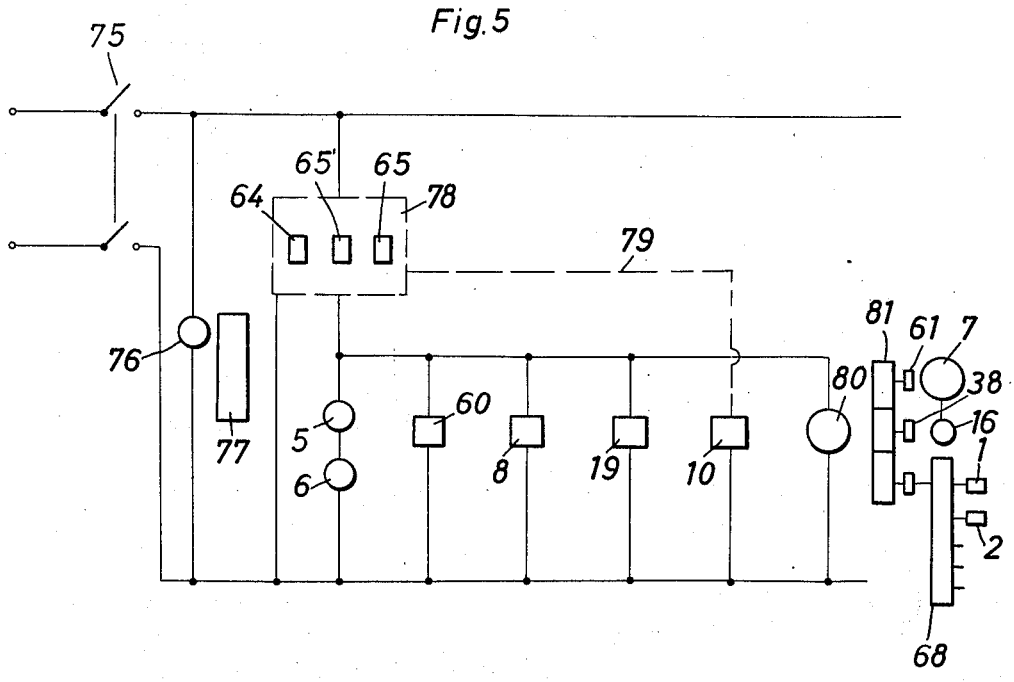

The system incorporates a gear drive, as is shown schematically at 68 in FIG. 5.

The cleaning device 15 comprises a cassette 19 which has an opening 20 at the end adjacent to the drum 7. The cleaning roller 16 is so mounted that it is positioned in this opening 20 with a part of its circumference outside the cassette 19 and with a part of its circumference within the cassette. While the upper edge 21 of the opening 20 is defined by the lower edge of an upper down-turned wall portion 54 which terminates at the opening, the lower edge of the opening is formed by a wall section 22 which is tangential to the roller 16 or is curved to confirm to the shape of the roller. This wall section 22 is a continuation of the bottom wall 23 of the cassette. The upper wall 24 of the cassette forms a continuation of the down-turned wall portion 54 which terminates in the upper edge 21 of the opening 20. Over the cleaning roller 16 is guided a cleaning web 59 of paper or film.

The upper gap of the cassette opening 20 between the roller 16 and the upper edge 21 of the opening is covered by the web 59 as it is fed from its storage location.

The upper wall and the base of the cassette are turned in towards one another at the end of the cassette remote from the roller 16, and the respective wall sections 25 and 26 at this position define a slot 27 through which the cleaning web 59 passes. The cassette can of course be opened in order to insert the web. For example, the cassette 19 may be divided into upper and lower parts along the line 69 shown in FIG. 1, or one side wall, for example wall 28 in FIG. 4, can be provided with a snap-fitting edge section 70 so that it is possible to gain entrance to the cassette from the side.

The side walls 28 and 29 of the cassette are reinforced by flanges 30 and 31 which terminate in bearing bushes 32 and 33 respectively. One end 34 of the core of the roller 16 projects through the bush 32 and the other end of the core terminates in the bush 33. The projecting end 34 of the core of the roller 16 is provided with diagonally opposing indentations 35 in which pins 36 of a driven shaft 37 mounted in the side plate 17 by means of a bearing sleeve 71 can engage, said shaft 37 also carrying a drive wheel 38 outside the side plate 17. A spring-loaded index pin 39 engages in the bush 33 or in the core which terminates in it. The index pin 39 can be drawn back against the action of a spring 41 for replacement purposes by means of a hand grip 40 and is mounted in the side plate 18. The index pin 39 is guided for longitudinal displacement in a bearing sleeve 72 which is fixed in the side plate 18. The spring 41 seats on the one hand against the bearing sleeve 72 and on the other hand against an annulur flange 73 on the index pin 39.

The described bearing or support means for the roller 16 form the support element also for the cleaning web store.

For additional support between the side plates 17 and 18 for the end of the cassette remote from the roller 16 a bearer 42 may be provided, since the cassette would otherwise be pivotable about the core of the roller 16.

It will be appreciated that the cassette, which has a hand grip 43 at one side, in front of which in the side plate 18 an opening recess is provided, can be lifted out with the roller 16 after drawing back the index pin 39. The cassette of course lies partially below and partially above the line of the index pin and the side plate opening itself thus also extends above and below the line of the index pin 39.

The bearing support for the core of the roller 16 is so arranged that the roller, as shown in FIGS. 2 and 3, is held under pressure against the peripheral surface of the drum 7. The arrows on the drawings also show that the roller 16 is driven in the direction of rotation opposite to that of the drum 7 so that in the preferred embodiment a wiping effect is achieved.

The interior of the cassette is divided by a wall or partition 44 into two chambers 45 and 46. The first of these acts as a storage chamber for the concertina-like folded unused cleaning web and the second receives the used cleaning web. The cleaning web itself feeds through the slot 27 over the upper wall 24 of the cassette in the direction of the arrow 47 and on to the pressure roller 16, and from there it is taken up and guided back into the chamber 46. It has been shown that the use of the pressure roller 16 as the sole guide and drive element for the cleaning web is sufficient, and that the build-up of the used web at 60 in the chamber 46 exerts sufficient pressure against the stored web within the chamber 45 to be able to displace the partition 44 gradually towards the end wall provided with the slot 27 and for example to push it into the position 44' shown in FIG. 3. The orientation of the partition 44 is primarily governed by the concertina-like folding of the supply of cleaning web filling the whole volume of the chamber 45. The initial position of the partition 44 can be defined by internal stops 48 and 49.

It will be appreciated that the side walls of the cassette can be raised by means of edge flanges 50 along the sides of the upper wall 24 in order to form lateral guides for the path of the cleaning web 59. The same applies also to the rear wall of the cassette 19 above the slot 27 where such a flange is shown at 51.

The displacement of the partition 44 also represents a sufficient drag in conjunction with the concertina-like folding of the web for regulated withdrawal of the cleaning web.

By way of example, in order to provide an indicator device indicative of the amount of unused web, the partition wall 44 is fitted with a magnet 52. This magnet 52 is associated outside the cassette with a reed switch 53 which can be connected to a signal source, acoustic or optical, or with a switch in the machine drive, in order to indicate at the appropriate time that the supply of cleaning web has reached a predetermined low level or to arrange that in this state the machine drive is switched off. Further such reed switches 53 may be provided adjacent to the side of the cassette in order to provide a prior indication of the degree to which the cleaning web has been used up.

An arrangement with magnetic actuation such as this has the advantage of being able to produce a practically completely closed cassette. There is also the alternative possibility of providing a projection on the partition wall for actuating external wiping contacts next to the cassette through a slot in the cassette wall.

The turned-down wall section terminating in the edge 21, this wall section being indicated at 54, serves in the preferred embodiment also as a bearer for stripper blades 55, 56, 57, 58 which are positioned perpendicular to the longitudinal axis of the pressure roller 16 and which engage in slots in the roller in order to guide the cleaning web entrained by the roller into the chamber 46. These stripper blades which are let into the circumference of the roller have the simultaneous function of dividing up the material or the surface of the roller 16, although the splitting up of the surface is such as to ensure that a substantially closed pressure surface is still presented to the drum 7. This is also ensured if the roller is provided with short bristles or rubber dimples so that again the stripper blades, which may for example have a width of one millimeter, counteract any rigidification of the roller surface.

The cleaning web 59 is entrained by the pressure generated between the cleaning roller 16 and the drum 7. The support means for the cleaning roller are so arranged that a sufficient pressure is created by resilient mounting of the cleaning roller 16 at its bushings.

From FIG. 4 it will be seen that the drum 7 is mounted on a shaft 74 in the side plates 17 and 18. The shaft 74 is extended at one end and carries at this end, substantially parallel to the drive wheel 38, a drive wheel 61 which is driven at a speed or in a direction different from that of the drive wheel 38.

The circuit diagram shown in FIG. 5 shows that on actuation of a main switch 75 a driving motor 76 is switched on and this is connected to a unit 77 for all the continuously driven components. This may include for example feed rollers, not shown in detail in FIG. 1, in the path of movement 13 of the copy sheets, as well as for example a fan and other like components. The remaining components are grouped in a circuit 78 in which the two switches 64 and 65 are connected in known manner in order that during the passage of an original over the exposure aperture the illumination light sources 5 and 6, the charging device 60, the developing device and the toner or pigment scattering device 8, the fixing or fusing device 14, and also by means of special controls through a connection 79 the withdrawal mechanism 10 for the copy sheet store 9, are all switched into operation, and also possibly the sheet removal device 12 or a fan forming part of it. Furthermore, at the correct working cycle a drive motor 80 is switched on which is connected to a gear unit 81. This is sub-divided and drives the drive wheels 61 and 38 for the drum 7 and for the cleaning roller 16 respectively at appropriate speeds and in appropriate directions, and also drives the above-mentioned gear unit 68 which for example drives the rollers 1, 2 of the roller pairs indicated by those numbers.

Where reference is made above to a cleaning web 59 this is intended to include any strip-form or sheet-form material which has a good wiping or cleaning effect. In the preferred embodiment, the web-form material does not form a closed loop.

I claim:

1. An electrophotographic copying machine comprising a continuously rotating transfer element having a photoconductive surface, means adjacent to said surface to charge the transfer element surface electrostatically, means to cause an image of an original to be copied to be exposed to the charged transfer element surface to create a latent image thereon, developer means to develop the latent image, transfer means operative to transfer the developed image to image-receiving material, cleaning means for cleaning the transfer element surface at a location between said transfer means and said charging means, said cleaning means comprising storage means for a cleaning web, a cleaning web within said storage means and a pressure roller in contact with the transfer element surface; said storage means having a first chamber for storing unused cleaning web and a second chamber for storing used cleaning web in a random fashion; guide means associated with said storage means for guiding the cleaning web along a path from said first chamber, around said pressure roller and into said second chamber; first drive means for said transfer element, second drive means for said pressure roller, said first and second drive means being so arranged that the speed of rotation of said transfer element differs from the peripheral speed of said pressure roller, said pressure roller being arranged to entrain the web against the transfer element and in association with said guide means to pass the used web into said second chamber for storage in said random fashion, said pressure roller being the only drive means for removing the unused cleaning web from said first chamber and returning the used cleaning web to said second chamber.

2. A machine as claimed in claim 1, wherein the pressure roller has a resilient surface whose resilience is such that with uniform pressure against the surface of the transfer element the pressure roller surface adapts itself to the transfer element surface to entrain the web.

3. A machine as claimed in claim 1, wherein said pressure roller has a longitudinal axis and which includes stripper means to remove the web from the pressure roller and direct it to said second chamber, said stripper means comprising tongue elements set perpendicular to said longitudinal axis of the pressure roller.

4. A machine as claimed in claim 1, wherein said storage means comprises a cassette for storing said cleaning web, bearing means for the pressure roller in side walls of the cassette, said cassette having an opening associated with said bearing means, said pressure roller being positioned at least partially in said opening, and the cleaning web being guided from within said cassette to the outer surface of the pressure roller and through said opening back into the cassette.

5. A machine as claimed in claim 4, in which the pressure roller is positioned as a closure element for said opening in the cassette.

6. A machine as claimed in claim 5, wherein said guide means for the cleaning web is on the exterior surface of the cassette, and wherein an upper gap of said cassette opening between the pressure roller and the adjacent cassette wall is covered by the cleaning web passing to the pressure roller, and wherein a lower edge of said opening in the cassette is formed by a wall section which conforms to the pressure roller.

7. A machine as claimed in claim 5, in which the cassette includes a partition wall which divides the interior of the cassette into said first and second chambers and the cleaning web is folded in concertina fashion in said first chamber of the cassette, said first chamber being positioned on the side of the partition wall remote from the pressure roller.

8. A machine as claimed in claim 5, in which the cassette includes a partition wall which divides the interior of the cassette into said first and second chambers and said partition wall cooperates with an indicator device which is positioned externally of the cassette, thereby to provide in dependence upon the position of the partition wall an indication of the amount of unused cleaning web.

9. A machine as claimed in claim 8, in which a magnet is mounted on the partition wall and at least one sensor is provided externally of the cassette to be triggered in dependence upon the relative position of said magnet.

10. An electrophotographic copying machine comprising a continuously rotating transfer element having a photoconductive surface, means adjacent to said surface to charge the transfer element surface electrostatically, means to cause an image of an original to be copied to be exposed to the charged transfer element to create a latent image thereon, developer means to develop the latent image, transfer means operative to transfer the developed image to image-receiving material, cleaning means for cleaning the transfer element surface at a location between said transfer means and said charging means, said cleaning means comprising storage means for a cleaning web, a cleaning web within said storage means and a pressure roller in contact with the transfer element surface; said storage means having a first chamber for storing unused cleaning web and a second chamber for storing used cleaning web in a random fashion; guide means associated with said storage means for guiding the cleaning web along a path from said first chamber, around said pressure roller and into said second chamber; first drive means for said transfer element, second drive means for said pressure roller, said first and second drive means being so arranged that the speed of rotation of said transfer element differs from the peripheral speed of said pressure roller, guide means on the path of the cleaning web from said store, said pressure roller being arranged to entrain the web against the transfer element and in association with said guide means to pass the used web into said second chamber from storage in said random fashion, said pressure roller being the only drive means for removing the unused cleaning web from said first chamber and for returning the used cleaning web to said second chamber; stripper means to remove the web from the pressure roller and direct it to said second chamber, said stripper means including tongue elements set perpendicular to the longitudinal axis of the pressure roller, said tongue elements engaging in the surface of the pressure roller and said roller being provided with a slot at the location of each tongue element, the tongue elements being located at a portion of the pressure roller remote from the transfer element surface.

11. An electrophotographic copying machine, comprising a continuously rotating transfer element having a photoconductive surface, means adjacent to said surface to charge the transfer element surface electrostatically, means to cause an image of an original to be copied to be exposed to the charged transfer element to create a latent image thereon, developer means to develop the latent image, transfer means operative to transfer the developed image to image-receiving material, cleaning means for cleaning the transfer element surface at a location between said transfer means and said charging means, said cleaning means comprising storage means for a cleaning web, a cleaning web within said storage means and a pressure roller in contact with the transfer element surface; said storage means having a first chamber for storing unused cleaning web and a second chamber for storing used cleaning web in a random fashion; guide means associated with said storage means for guiding the cleaning web along a path from said first chamber, around said pressure roller and into said second chamber; first drive means for said transfer element, second drive means for said pressure roller, said first and second drive means being so arranged that the speed of rotation of said transfer element differs from the peripheral speed of said pressure roller, said pressure roller being arranged to entrain the web against the transfer element and in association with said guide means to pass the used web into said second chamber for storage in said random fashion, said pressure roller being the only drive means for removing the unused cleaning web from said first chamber and for returning the use cleaning web to said second chamber; said storage means comprising a cassette for storing said cleaning web, bearing means for the pressure roller in side walls of the cassette, said cassette having an opening associated with said bearing means, said pressure roller being positioned at least partially in said opening, the cleaning web being guided from the store to the outer surface of the pressure roller and through said opening back into the cassette and wherein the cassette includes a partition wall which divides the interior of the cassette into first and second chambers, said partition wall being movably mounted and being movable in dependence upon a reduction in the amount of unused in said first chamber web and an increase in the amount of used web in the second chamber.

12. A machine as claimed in claim 11, in which said bearing means for the pressure roller constitutes the sole mounting means for both said pressure roller and the cleaning web store.

13. A machine as claimed in claim 11, in which the cassette is pivotally mounted adjacent to one end on said bearing means for the pressure roller, and in which a bearer is provided supporting the other end of the cassette.

14. A machine as claimed in claim 13, in which the pressure roller is provided at one end with a coupling device for connection to a driven shaft of the machine, and is mounted at its other end on a retractable, spring-loaded index pin which is engageable with the pressure roller.

* * * * *